US007083408B1

(12) United States Patent
Donnelly

(10) Patent No.: US 7,083,408 B1
(45) **Date of Patent: *Aug. 1, 2006**

(54) APPARATUS AND METHOD FOR SHUTTING DOWN A FUEL FIRED APPLIANCE

(75) Inventor: Donald E Donnelly, Fenton, MO (US)

(73) Assignee: Emerson Electric Co, St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/157,477

(22) Filed: Jun. 21, 2005

Related U.S. Application Data

(63) Continuation of application No. 10/799,159, filed on Mar. 12, 2004, now Pat. No. 6,908,300.

(51) Int. Cl.
*F22B 37/42* (2006.01)
*F23N 5/24* (2006.01)

(52) U.S. Cl. ..... 431/22; 431/6; 431/13; 431/16; 431/76; 122/504

(58) Field of Classification Search ..... 431/22, 431/13, 16, 6, 76; 122/504
See application file for complete search history.

(56) References Cited

U.S. PATENT DOCUMENTS 3,896,422 A * 7/1975 Kowalsky ..... 340/547
4,171,944 A * 10/1979 Hirschmann ..... 431/22
4,334,258 A * 6/1982 Seeman et al. ..... 361/170
4,482,311 A * 11/1984 Wada et al. ..... 431/15
4,638,789 A * 1/1987 Ueki et al. ..... 122/14.21
5,003,960 A * 4/1991 Hanagan ..... 126/39 BA
5,165,883 A * 11/1992 Van Bemmel ..... 431/6
5,239,980 A * 8/1993 Hilt et al. ..... 126/116 A
5,503,550 A * 4/1996 DePalma ..... 431/125
5,508,568 A * 4/1996 Mammen ..... 307/117
5,531,214 A * 7/1996 Cheek ..... 122/14.1
5,931,655 A * 8/1999 Maher, Jr. ..... 431/14
6,390,028 B1 * 5/2002 Langmead et al. ..... 122/14.2
6,554,608 B1 * 4/2003 Bowman et al. ..... 431/6
6,722,876 B1 * 4/2004 Abraham et al. ..... 431/22
2001/0038986 A1 * 11/2001 Abraham et al. ..... 431/22

* cited by examiner

*Primary Examiner*—Carl D. Price
(74) *Attorney, Agent, or Firm*—Harness Dickey & Pierce PLC

(57) ABSTRACT

An apparatus comprising a switch, a fuse, and a sensor that is capable of detecting the presence of flammable vapors and responsively changing in resistance, wherein the sensor enables the switch to supply current to the fuse which opens to shut down an appliance burner. The fuse is connected in series with a control circuit that enables a gas valve to supply gas to the burner 65. The apparatus comprises a voltage divider circuit that includes the sensor, which upon exposure to flammable vapors, increases in resistance to provide a voltage input to the gate of a FET 100. The FET switches on and conducts a current that blows the fuse to interrupt the appliance burner control circuit and shut down burner operation.

20 Claims, 3 Drawing Sheets

APPARATUS AND METHOD FOR SHUTTING DOWN A FUEL FIRED APPLIANCE

CROSS-REFERENCE TO RELATED APPLICATIONS

This application is a continuation of U.S. patent application Ser. No. 10/799,159 filed on Mar. 12, 2004, now issued U.S. Pat. No. 6,908,300, the disclosure of which is incorporated herein by reference.

STATEMENT REGARDING FEDERALLY SPONSORED RESEARCH OR DEVELOPMENT

Not applicable.

BACKGROUND OF THE INVENTION

The present invention generally relates to fuel-fired heating appliances such as water heaters, and more particularly relates to an apparatus for sensing the presence of flammable vapors near the burner of a fuel-fired appliance and responsively shutting down the operation of the burner.

Residential and commercial gas-fired water heaters typically comprise a main burner and a standing pilot burner disposed within a combustion chamber below a cylindrical water tank. The burner is supplied with gas through a gas valve, and with air through an air inlet screen. Such standing pilot water heaters vent the combustion air without the use of a fan, and operate independent of the electrical power within the building. While conventional water heater appliances of this type operate reliably and safely, there may exist the possibility that the burner could cause flammable vapors external to the appliance to be ignited. The resulting flame could potentially propagate out of the appliance into the ambient environment around the appliance.

Efforts to mitigate the potential hazard posed by the presence of flammable vapors in proximity to a gas burning appliance have been previously directed to a control circuit in connection with a sensor that responds to flammable vapors by changing resistance to effect shut down of burner operation. Burner operation may be restored when the sensor returns to its original resistance after the vapors dissipate. These previous types of sensor systems do not indefinitely shut down the burner from further operation upon first detecting the presence of flammable vapors. The flammable vapor sensors presently used, however, have been known to become erratic and unreliable once they are exposed to a significant concentration of flammable vapors. Accordingly, a sensor system that will lockout the burner from further operation until the sensor is replaced is desired. Attempts have been previously made to employ a microprocessor to shut off burner operation in response to a sensor detecting the presence of flammable vapors. Such microprocessor-based electronic systems have the ability to lockout the appliance upon detecting the presence of flammable vapors, but necessitate the provision of a power source for the microprocessor. This approach is either too expensive if such a microprocessor control requires installation of electrical power for replacement of an existing water heater, or too impractical if the microprocessor's power consumption results in frequent battery replacement. There still exists a need for an inexpensive, low maintenance flammable vapor sensing apparatus that is able to directly interrupt the appliance burner circuit and indefinitely shut down the burner operation of a gas-fired appliance until the apparatus can be replaced.

SUMMARY OF THE INVENTION

There is provided, in accordance with one aspect of the invention, an apparatus comprising a switch, a fuse, and a sensor that is capable of detecting the presence of flammable vapors and responsively changing in resistance, wherein the sensor enables the switch to supply electrical current to the fuse which opens to shut down the appliance burner. The fuse is connected in series with an appliance control circuit that enables a gas valve solenoid to supply gas to the burner. The apparatus comprises a voltage divider circuit that includes the sensor, which upon exposure to flammable vapors, increases in resistance to change a voltage input to the gate of a Field Effect Transistor switching device. When the sensor is exposed to flammable vapors, the voltage divider will provide an on voltage to the gate, and the FET will switch on and conduct a large current through the fuse in the appliance control circuit and the solenoid of the gas valve. The large current will cause the fuse to blow open and interrupt the appliance burner control circuit to shut down burner operation. Furthermore, the disabled fuse provides a lockout for the appliance burner control circuit to prevent further burner operation.

The present invention overcomes the shortcomings of the previously known approaches for shutting down burner operation upon sensing the presence of flammable vapors, by blowing a fuse for disabling the burner control circuit. This prevents further operation of the appliance until the flammable vapor sensing apparatus can be replaced or serviced. The apparatus can be used for both a new production appliance, and also for replacement of an existing appliance without the need for wiring electrical power to the appliance. The low current draw of the flammable vapor sensing circuit allows for prolonging the life of the batteries, which are capable of generating sufficient current to overload a fuse for disabling burner operation.

It is therefore an object of the present invention to provide an apparatus capable of sensing the presence of flammable vapors in the ambient environment around a fuel-fired heating appliance, and responsively shutting down and locking out further operation of the appliance burner until the apparatus can be serviced.

Another object of the present invention is to provide an apparatus that can be easily installed on a fuel-fired appliance, for enabling shut down of the appliance burner when flammable vapors are present.

Another object of the present invention is to provide an apparatus for detecting the presence of flammable vapors having a simplified construction with low cost, long battery life and reliable operation.

Still another object of the present invention is to provide an apparatus that can alert an occupant of a low battery condition by intermittently activating an audible alarm, and can further alert an occupant of flammable vapor presence by fully activating an audible alarm.

These and other features and advantages of the present invention will become apparent from the following detailed description of a preferred embodiment for a gas fired water heater design, as well as the designs of other types of fuel fired heating appliances, which illustrates by way of example the principles of the invention

DETAILED DESCRIPTION OF THE INVENTION

Figure 1:
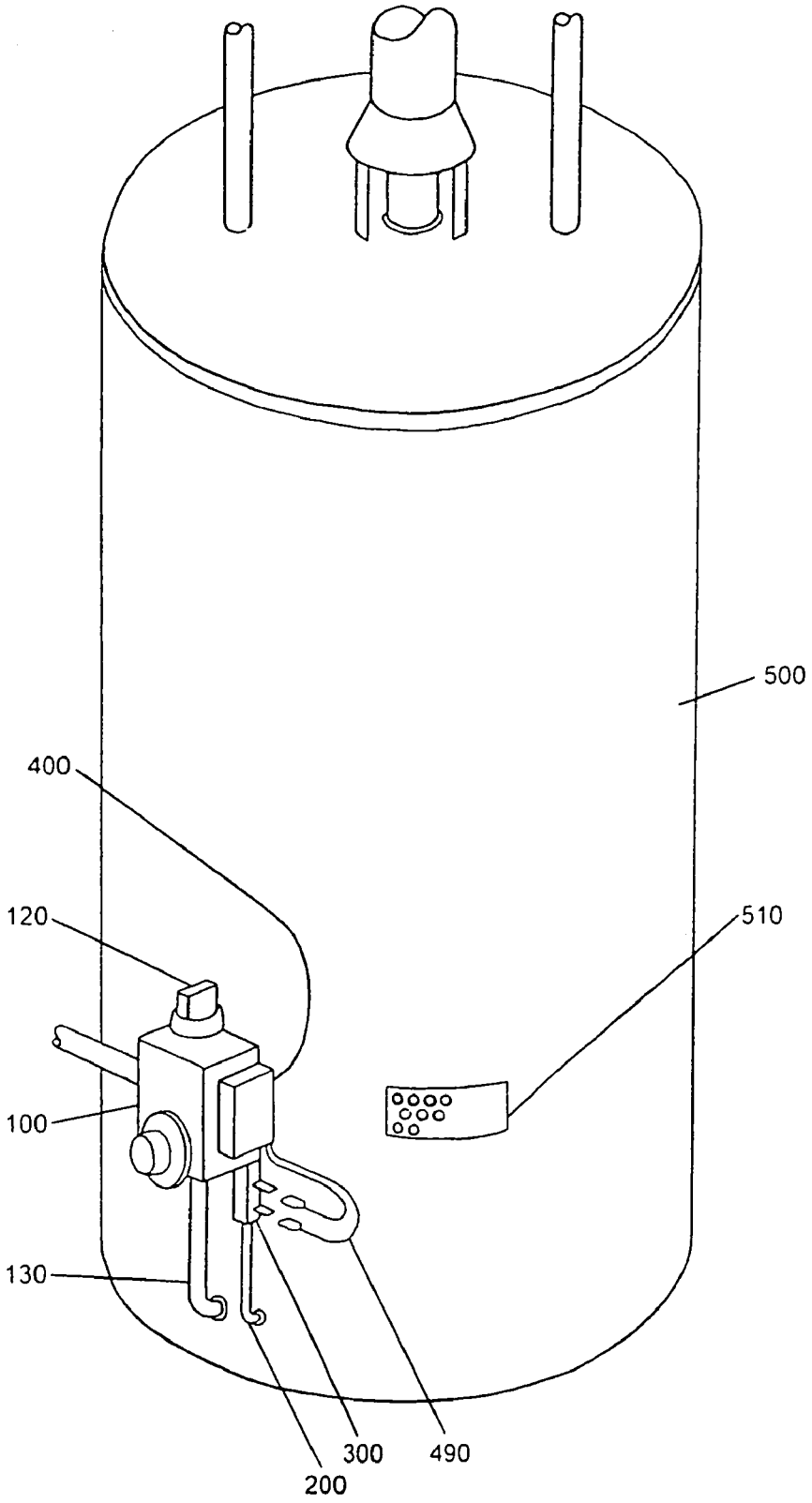
FIG. 1 is an illustration of a gas water heater employing the flammable vapor sensing apparatus according to the principles of the present invention.

The apparatus according to the principles of the present invention is illustrated in FIG. 1, which shows the apparatus 400 attached to a gas valve 100 of a gas water heater appliance 500. A typical gas water heater appliance generally has a burner disposed within a combustion chamber at the bottom of the appliance below a cylindrical water tank. FIG. 1 illustrates such a water heater having a gas valve 100 for supplying gas through tube 130 to the burner, and an air inlet screen 510 for supplying air to the burner (not shown). The appliance also comprises a thermocouple 200 for generating a voltage when exposed to a flame. The typical water heater appliance gas valve 100 has a knob 120 that must be depressed to supply gas while lighting a pilot burner flame. The pilot flame generates a thermocouple voltage that is in connection with the gas valve 100, for enabling the valve to supply gas to the burner at the bottom of the water heater appliance 500. The thermocouple of the water heater appliance 500 is a 12 grid power generator that can provide up to 217 milliamps, and is manufactured by White-Rodgers, a Division of Emerson Electric Co.

The thermocouple 200 shown in FIG. 1 is connected to a gas valve circuit of the gas valve 100 through an adapter 300. The adapter 300 comprises terminals for connection of the apparatus in series with the thermocouple 200 and gas valve circuit of the gas valve 100. The adapter 300 of the present invention is preferably an Energy Cut Off for a thermocouple, part number F145-1109 manufactured by White-Rodgers, a Division of Emerson Electric Co. It should be noted that the adaptor for enabling connection with the thermocouple may be any suitable adapter, and may also be incorporated into the construction of the thermocouple itself. Connectors 490 provide for connection of the apparatus 400 in series with the gas valve circuit and thermocouple voltage through the adapter 300. Specifically, the apparatus 400 comprises a fuse that is connected in series with the gas valve circuit and thermocouple voltage, and a sensor that detects the presence of flammable vapors and responsively causes the fuse to open to interrupt the gas valve circuit and the supply of gas to the burner to shut down the appliance. The apparatus 400 therefore can sense the presence of flammable vapors around the gas water heater 500, and shut down the operation of the appliance before the flammable vapors can accumulate and rise to the air inlet 510 of the water heater.

Figure 2:
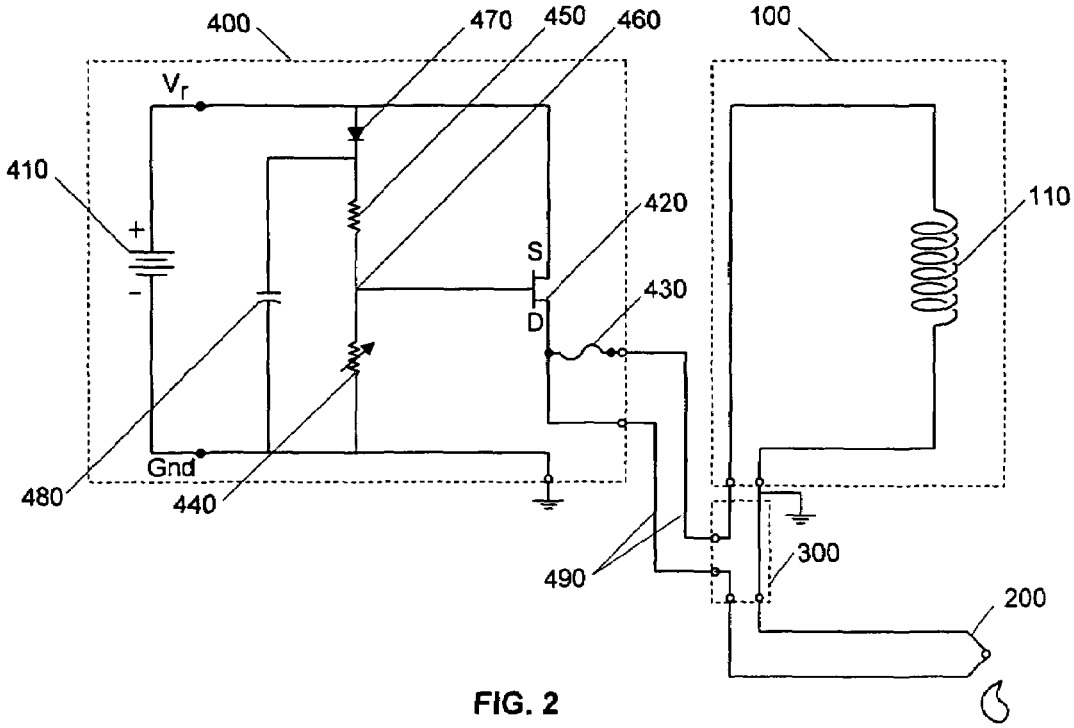
FIG. 2 is a circuit diagram of an appliance burner control circuit in connection with the flammable vapor sensing apparatus according to the principles of the present invention.

A circuit diagram of the apparatus is shown in FIG. 2, and more specifically details the connection of the apparatus in series with the previously described gas valve circuit. The apparatus is generally indicated as 400 in FIG. 2, and comprises a battery 410 connected to a voltage divider circuit comprising a resistor 450 and a sensor 440. The voltage divider circuit is designed such that it draws very low current to allow for long battery life. The sensor 440 is capable of detecting the presence of flammable vapors and responsively changing in resistance. Specifically, the particular sensor of the present invention increases in resistance as the flammable vapor concentricity rises, and is a polymer-absorption chemiresistor manufactured by Therm-o-disc Corporation. The resistance of the sensor is about 15 k to 20 k ohms in the absence of flammable vapors, and upon exposure to 50 percent of the low flammability level concentration of flammable vapors the resistance increases to over 100 k ohms within about 60 seconds. When the sensor 440 detects a 50 percent low flammability level concentration, the voltage potential at node 460 of the voltage divider circuit rises to a level that will gate on a Field Effect Transistor 420. The Field Effect Transistor (FET) is thereby switched on when the sensor 440 detects a predetermined flammable vapor concentration, such that the FET 420 switches current from the battery 410 to a fuse 430 in connection with the gas valve circuit 100. The battery then generates a large current between Vr and ground through the fuse 430 and a coil 110 of the gas valve circuit that operates a solenoid of the gas valve 100. The large current will cause the fuse 430 to blow, or open, to interrupt the thermocouple voltage at 200 connected through the fuse 430 to the gas valve coil 110, which will cause the solenoid of the gas valve to shut off gas flow through the valve to the burner and shut down the appliance. To ensure the battery 410 will be able to provide sufficient current to blow the fuse 430, a diode 470 in series with the voltage divider circuit and a capacitor 480 parallel to the voltage divider circuit are provided to maintain the battery voltage when the sudden increase in current occurs when the FET 420 is switched on and the battery voltage drops. The fuse of the present invention is preferably a R459.375 manufactured by Little Fuse, and is rated to open at a current in the range of about 0.5 to 0.6 amps.

In operation, the thermocouple 200 is exposed to flame to generate a voltage that is applied to the gas valve coil 110 of the gas valve 100. The thermocouple voltage is connected to the adaptor 300, which allows for connection of the fuse 430 in series between the thermocouple and the gas valve coil 110. The fuse is connected in series with the gas valve circuit through the adaptor 300 via connection leads 490. Accordingly, the thermocouple supplies current through the adapter 300, through the leads 490 and the fuse 430, and through the gas valve coil 110 for enabling the gas valve 100 to supply gas for operation of the burner appliance. In the absence of flammable vapors, there is no battery current through the FET 420, the fuse 430 and the gas valve coil circuit. When the sensor 440 detects the presence of a predetermined flammable vapor concentration, the voltage divider provides a voltage potential at node 460 that gates the FET 420 on to switch a large current from the battery 410 through the fuse 430, the connector leads 490, the gas valve coil 110 and to the ground of the battery 410. The FET 420 also switches current through the connector leads 490 and through the thermocouple circuit 200 to the ground of the battery 410. The fuse will blow, or open after about 5 seconds, at which time the connection of the battery 410 with the gas valve coil 110 will be interrupted. Likewise, the thermocouple 200 will no longer be connected to the gas valve coil 110. It should be noted that the ground connection shown at the connector 300 and the apparatus 400 complete the battery circuit back to the ground of the battery. This connection may be provided by a grounding jumper between the adapter 300 and the apparatus 400, or by a physical ground connection of the apparatus 400 to the gas valve 100 and adapter 300.

Once the fuse 430 of the apparatus 400 has opened, the gas valve coil 110 that operates a solenoid will be de-energized to discontinue the flow of gas through the gas valve 100 to the appliance burner. Even if the sensor returns to its nominal resistance when the flammable vapors have dissipated, attempts to restore the gas valve's operation will not be possible. Depressing the gas valve knob 120 will supply gas to the pilot burner, but lighting the pilot flame will not provide a thermocouple voltage to the gas valve coil 110 since the open fuse 430 has interrupted the connection to the gas valve coil 110. Thus, subsequent attempts to restore operation of the appliance burner will not be possible until the apparatus is serviced by a repair technician. Replacement of the sensor 440, or the apparatus 400, will ensure reliable sensor operation for detecting the presence of flammable vapors in the proximity of the appliance. The present invention accordingly provides an apparatus for shutting down an appliance burner that has a simplified construction with low cost, long battery life and reliable sensing of the presence of flammable vapors.

Figure 3:
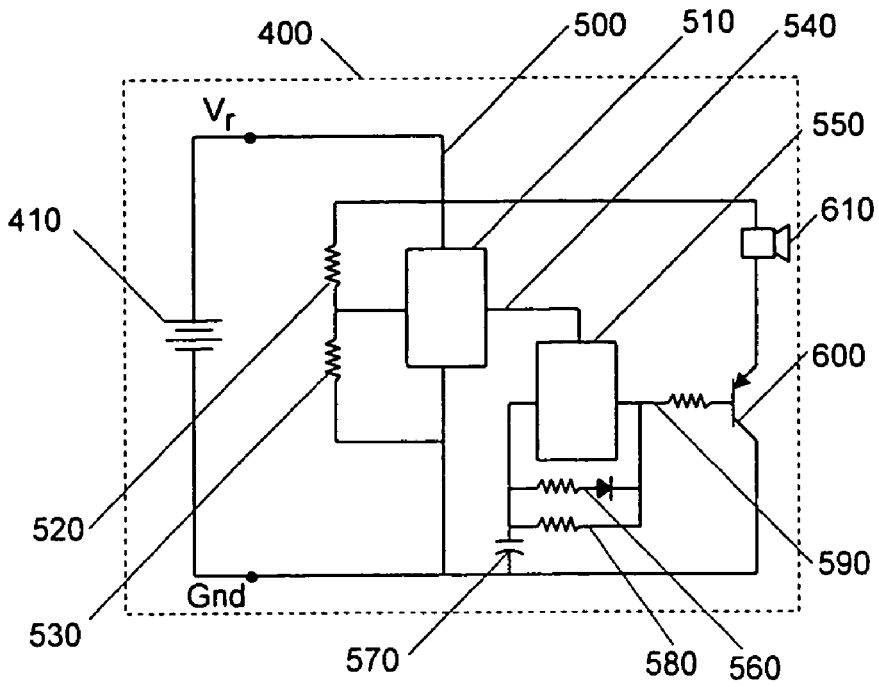
FIG. 3 is a circuit diagram of the apparatus further comprising an audible alarm and low battery voltage detection means according to the principles of the present invention.

The apparatus may also further comprise a voltage monitoring circuit shown in FIG. 3 that can detect a low battery voltage condition. The battery 410 of the apparatus 400 is connected to a voltage monitoring circuit 500, which comprises a voltage comparator 510 and two resistors 520 and 530. The resistors 520 and 530 are sized to establish a reference for comparison with the battery voltage level at 500. If the battery voltage level at 500 drops below the reference voltage, the voltage comparator 510 outputs a voltage at junction 540. The predetermined reference voltage of the present invention is preferably about 2.2 volts. The output at 540 of the voltage comparator 510 is input to a second voltage comparator 550. The second voltage comparator circuit comprises a resistor 580 and a capacitor 570 for establishing an RC time delay value. The second comparator 550 receives a voltage input from the first comparator 510 and intermittently outputs a voltage at junction 590 based on the RC time delay value. The intermittent output voltage at junction 590 drives a transistor 600 for intermittently switching on and off a self oscillating piezo 610, to accordingly provide an intermittent audible alarm for alerting an occupant that a low battery condition has been detected. The voltage comparators of the present invention are preferably a MIC842H, manufactured by MICREL, but may be any suitable voltage comparator.

Figure 4:
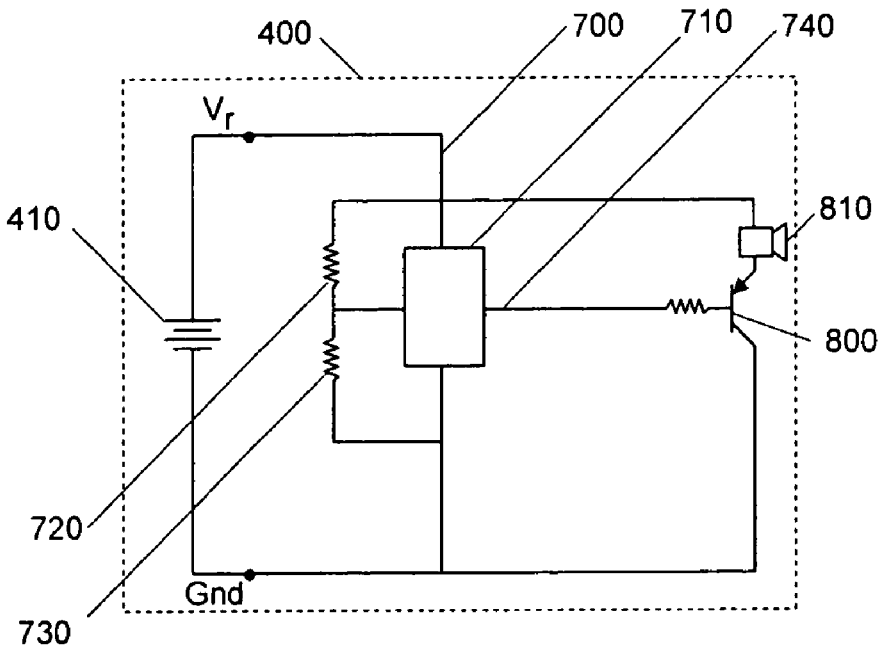
FIG. 4 is a circuit diagram of the apparatus further comprising an audible alarm and flammable vapor voltage detection means according to the principles of the present invention.

Likewise, the apparatus may also further comprise a voltage monitoring circuit shown in FIG. 4, which can detect when the sensor 440 detects a flammable vapor presence and causes the FET 420 to switch and the battery voltage to subsequently drop. When the battery power is switched to the fuse 430 upon detection of flammable vapors, the battery voltage of the present invention drops to about 1.5 volts. By connecting the battery 410 of the apparatus 400 to a voltage monitoring circuit 700, the circuit 700 can activate an audible alarm to alert an occupant of the presence of flammable vapors. The voltage monitoring circuit 700 comprises a voltage comparator 710 and two resistors 720 and 730. The resistors 720 and 730 are sized to establish a reference for comparison with the battery voltage level at 700. If the battery voltage level at 700 drops below a reference voltage of 1.5 volts indicative of a flammable vapor presence, the voltage comparator 710 outputs a voltage at junction 740. The output voltage at junction 740 drives a transistor 800 for switching on a self oscillating piezo 810, to accordingly provide an audible alarm for alerting an occupant that a flammable vapor presence has been detected. The voltage comparator 710 of the present invention is preferably a MIC842H, manufactured by MICREL, but may be any suitable voltage comparator.

It should be noted that the fuse 430 that serves as the circuit interrupting device of the present invention may also be replaced with a latching relay device that can interrupt the thermocouple circuit. The output of the FET may be used to activate a relay coil, which would open a set of normally closed contacts in connection with the thermocouple voltage and the gas valve coil circuit. The latching relay would remained in its present open state, thereby providing the same indefinite shut down of the gas valve circuit and burner operation as the fuse device.

Additional design considerations, readily apparent to one of ordinary skill in the art, such as modification of the apparatus to incorporate a low-cost microprocessor with reduced power consumption that may become available in the future, may enable simplification of circuitry and improved battery life in the present invention. It should be apparent to those skilled in the art that various modifications such as the above may be made without departing from the spirit and scope of the invention. More particularly, the apparatus may be adapted to any of a variety of different gas fired appliances including gas clothes dryers and furnaces. Accordingly, it is not intended that the invention be limited by the particular form illustrated and described above, but by the appended claims.

What is claimed is:

1. A control circuit for shutting off a fuel-fired appliance burner having a thermocouple voltage that enables a gas valve solenoid to supply fuel to the appliance burner, the control circuit comprising:

at least one battery power source for powering the control circuit;

a fuse that is connected in series with the gas valve solenoid of the appliance in a manner such that the thermocouple voltage to the gas valve solenoid is interrupted when the fuse opens to cause the flow of gas to the burner to be shut off;

a switching means for switching power from the at least one battery power source to the fuse to cause the fuse to open;

a sensor capable of detecting the presence of flammable vapor, where the sensor responsively changes in resistance as the concentration of flammable vapor changes;

a low battery level detection circuit capable of detecting when the voltage of the at least one battery power source is less than a predetermined value that is indicative of a low battery voltage condition, and responsively providing an output signal for alerting an occupant of the low battery voltage condition; and a voltage divider circuit comprising a resistor and the sensor, the voltage divider circuit having a voltage potential between the resistor and the sensor that controls activation of the switching means, wherein the detection of flammable vapors by the sensor causes the voltage potential of the voltage divider to activate the switching means and open the fuse to cause the flow of gas to the burner to be shut-off.

2. The control circuit of claim 1, wherein the sensor's resistance increases as the concentration of flammable vapor increases.

3. The control circuit of claim 2, wherein the switching means comprises a field effect transistor that is gated on by the voltage potential of the voltage divider circuit.

4. The control circuit of claim 3, wherein the voltage potential of the voltage divider circuit gates the field effect transistor on when the sensor detects a predetermined flammable vapor concentration.

5. The control circuit of claim 4, wherein the predetermined flammable vapor concentration is about 50 percent of the lower flammability level.

6. The control circuit of claim 5, wherein the control circuit further comprises an intermittent audible alarm means for alerting an occupant when the low battery level circuit detects a low battery condition.

7. The control circuit of claim 6, wherein the control circuit further comprises an audible alarm means for alerting the user of the gas appliance when the sensor detects the predetermined level of flammable vapor concentration.

8. A control circuit in connection with a thermocouple voltage source and a gas valve circuit of an appliance, for shutting off the flow of gas to discontinue operation of the appliance burner, the control circuit comprising:

at least one battery power source for powering the control circuit;

a fuse that is connected in series with the thermocouple voltage source and gas valve circuit, for interrupting the thermocouple voltage to the gas valve circuit to cause the flow of gas to the burner to be shut off;

a switching means for switching power from the at least one battery power source to the fuse to cause the fuse to open and interrupt the gas valve circuit;

a sensor capable of detecting the presence of flammable vapor, where the sensor responsively changes in resistance as the concentration of flammable vapor changes;

a low battery level detection circuit capable of detecting when the voltage of the at least one battery power source is less than a predetermined value that is indicative of a low battery voltage condition, and responsively providing an output signal for alerting an occupant of the low battery voltage condition; and a voltage divider circuit incorporating the sensor, wherein the detection of flammable vapors by the sensor causes a voltage potential in the voltage divider to activate the switching means and open the fuse to cause the flow of gas to the burner to be shut-off.

9. The control circuit of claim 8, wherein the sensor's resistance increases as the concentration of flammable vapor increases.

10. The control circuit of claim 9, wherein the switching means comprises a field effect transistor that is gated on by the voltage potential in the voltage divider circuit.

11. The control circuit of claim 10, wherein the voltage divider circuit gates the field effect transistor on when the sensor detects a predetermined flammable vapor concentration.

12. The control circuit of claim 11, wherein the predetermined flammable vapor concentration is about 50 percent of the lower flammability level.

13. The control circuit of claim 9, wherein the switching means comprises a relay.

14. The control circuit of claim 12, wherein the power source comprises exactly two batteries.

15. The control circuit of claim 14 wherein the control circuit comprises a low battery level detection circuit for sensing a battery voltage less than about 2.2 volts that is indicative of a low battery voltage condition.

16. The control circuit of claim 14, wherein the control circuit further comprises an intermittent audible alarm means for alerting an occupant when the low battery level circuit detects a low battery condition.

17. The control circuit of claim 16, wherein the control circuit further comprises an audible alarm means for alerting the user of the gas appliance when the sensor detects the predetermined flammable vapor concentration.

18. A method of controlling the operation of a gas appliance having a thermocouple voltage source and gas valve circuit for enabling gas flow to a burner, a fuse in series with the gas valve circuit, a switch, a battery, and a flammable vapor sensor, the method comprising the steps of:

sensing a low battery voltage condition and responsively providing an output signal for alerting an occupant of the low battery condition;

sensing the presence of a predetermined flammable vapor concentration with a variable resistance sensor;

responsively actuating the switch to supply battery current to the fuse; and the fuse responsively blowing to interrupt the thermocouple voltage to the gas valve circuit such that the gas flow to the burner is shut off until the appliance can be serviced.

19. The method of claim 18, further comprising the step of sounding an audible alarm when the switch is actuated, for alerting an occupant of the predetermined flammable vapor concentration.

20. The method of claim 18 further comprising the step of sounding an intermittent audible alarm when the switch is actuated, for alerting an occupant of the low battery condition.

* * * * *